US007900471B2

(12) United States Patent
Leske

(10) Patent No.: US 7,900,471 B2
(45) Date of Patent: Mar. 8, 2011

(54) PRE-PACKAGED, FLEXIBLE CONTAINER OF ICE AND AIR

(75) Inventor: Thomas R. Leske, Oshkosh, WI (US)

(73) Assignee: S. I. Incorporated, Oshkosh, WI (US)

( * ) Notice: Subject to any disclaimer, the term of this patent is extended or adjusted under 35 U.S.C. 154(b) by 423 days.

(21) Appl. No.: 12/154,709

(22) Filed: May 27, 2008

(65) Prior Publication Data

US 2009/0293536 A1 Dec. 3, 2009

(51) Int. Cl.
*F25D 3/00* (2006.01)

(52) U.S. Cl. ..... 62/389; 62/530

(58) Field of Classification Search ..... 62/530, 62/259.1, 298, 60, 389, 372, 459, 464; 206/525, 206/286; 222/143, 146.6, 542; 426/115, 426/394; 220/592.16, 666
See application file for complete search history.

(56) References Cited

U.S. PATENT DOCUMENTS

| | | | |
|---|---|---|---|
| 2,611,225 | A | 9/1952 | Williams |
| 2,933,404 | A | 2/1960 | Adell |
| 3,151,668 | A | 10/1964 | Zimmermann |
| 3,423,902 | A | 1/1969 | Stroop |
| 3,470,672 | A | 10/1969 | Tuma |
| 3,535,409 | A | 10/1970 | Rohde |
| 3,565,389 | A | 2/1971 | Price |
| 3,685,645 | A | 8/1972 | Kawaguchi |
| 3,940,232 | A | 2/1976 | Stock |
| 4,109,792 | A | 8/1978 | Greenawalt et al. |
| 4,132,049 | A | 1/1979 | Mullins, Jr. |
| 4,347,848 | A | 9/1982 | Hubbard et al. |
| RE31,890 | E | 5/1985 | Vangedal-Nielsen |
| 4,587,810 | A | 5/1986 | Fletcher |
| 4,706,439 | A | 11/1987 | Barton |
| 4,783,042 | A | 11/1988 | Folkmar |
| 4,813,646 | A | 3/1989 | Fujio |
| 4,834,245 | A | 5/1989 | Ohga et al. |
| 4,886,239 | A | 12/1989 | Stimmel |
| 4,899,976 | A | 2/1990 | Cederroth et al. |
| 4,903,841 | A | 2/1990 | Ohsima et al. |
| 5,029,430 | A | 7/1991 | Davis |

(Continued)

FOREIGN PATENT DOCUMENTS

| | | |
|---|---|---|
| DE | 4121843 | 1/1993 |

(Continued)

OTHER PUBLICATIONS

Ilan Brat, Chew This Over: Munchable Ice Sells Like Hot Cakes, The Wall Street Journal, Wednesday, Jan. 30, 2008, Three pages, vol. CCLI No. 24.

*Primary Examiner* — Mohammad M Ali
(74) *Attorney, Agent, or Firm* — Thomas J. Connelly; Wilhelm Law, S.C.

(57) ABSTRACT

A pre-packaged, flexible container of ice and air is disclosed. The pre-packaged, flexible container includes a first member having a hermetically sealed outer periphery which encloses a cavity. The cavity has a volume of less than about 20 cubic inches. The flexible container also includes ice and air contained within the cavity. The ice is present as an individual piece or as multiple pieces. The remainder of the cavity is occupied by air. The air fills at least about 50% of the volume of the cavity. Furthermore, the container, ice and air have a combined weight of less than about 5 ounces.

20 Claims, 9 Drawing Sheets

U.S. PATENT DOCUMENTS

| | | | | |
|---|---|---|---|---|
| 5,067,306 | A | 11/1991 | Umezawa | |
| 5,088,300 | A | 2/1992 | Wessa | |
| 5,112,477 | A | 5/1992 | Hamlin | |
| 5,133,348 | A * | 7/1992 | Mayn | 607/108 |
| 5,356,426 | A * | 10/1994 | Delk et al. | 607/112 |
| 5,393,032 | A | 2/1995 | Cederroth | |
| D360,532 | S | 7/1995 | Suneborn | |
| 5,473,865 | A | 12/1995 | Tanaka et al. | |
| 5,527,012 | A | 6/1996 | Vinkel et al. | |
| 5,581,982 | A | 12/1996 | Schroeder et al. | |
| 5,584,086 | A * | 12/1996 | VanWinkle et al. | 5/644 |
| 5,630,310 | A | 5/1997 | Chadwell | |
| 5,707,645 | A * | 1/1998 | Wierson | 424/436 |
| 5,846,446 | A | 12/1998 | Jackson | |
| 6,112,539 | A | 9/2000 | Colberg | |
| 6,254,911 | B1 | 7/2001 | Komatsu | |
| 6,322,044 | B1 | 11/2001 | Vangedal-Nielsen | |
| 6,361,553 | B1 | 3/2002 | Bowen | |
| 6,422,032 | B1 * | 7/2002 | Greene | 62/457.2 |
| 6,470,705 | B2 * | 10/2002 | Bride-Flynn | 62/530 |
| 6,474,048 | B1 | 11/2002 | Metzger et al. | |
| 6,647,743 | B2 | 11/2003 | Moore | |
| 6,655,174 | B2 | 12/2003 | Moore | |
| D492,600 | S | 7/2004 | Moore | |
| 6,800,088 | B1 | 10/2004 | Karapetyan | |
| 6,830,582 | B1 | 12/2004 | Reid, Jr. et al. | |
| 6,868,694 | B2 | 3/2005 | Nielsen | |
| 7,093,816 | B2 | 8/2006 | Lacan et al. | |
| 7,104,291 | B2 | 9/2006 | Dalton et al. | |
| 7,207,156 | B2 | 4/2007 | Metzger | |
| 7,784,304 | B2 * | 8/2010 | Trinh et al. | 62/530 |
| 2002/0029584 | A1 | 3/2002 | Gibot et al. | |
| 2002/0153468 | A1 | 10/2002 | Folkmar | |
| 2006/0049328 | A1 | 3/2006 | Vangedal-Nielsen | |
| 2007/0175235 | A1 | 8/2007 | Metzger | |

FOREIGN PATENT DOCUMENTS

| | | |
|---|---|---|
| ES | 2214935 | 9/2004 |
| ES | 2215445 | 10/2004 |
| ES | 2253013 | 5/2006 |
| GB | 2334570 | 8/1999 |
| MX | 01004037 | 10/2002 |
| WO | 0114806 | 3/2001 |
| WO | 02100740 | 12/2002 |
| WO | 03104729 | 12/2003 |

* cited by examiner

PRE-PACKAGED, FLEXIBLE CONTAINER OF ICE AND AIR

FIELD OF THE INVENTION

This invention relates to a pre-packaged, flexible container of ice and air.

BACKGROUND OF THE INVENTION

Today, there are various situations where ice is served to a multitude of individuals in public venues. The primary commercial venue focuses on situations where a vendor hand-delivers a disposable paper or plastic glass or cup with ice to a customer. The vendor then distributes or sells a liquid or fluid, such as a bottle of water, a container or can of a beverage, such as a carbonated soft drink or a non-carbonated drink such as a sports drink, ice tea, juice, an alcoholic drink, a non-alcoholic drink, a liquid mixer to which alcohol can be added, etc. In many of these venues, the consumer does not have access to an ice machine. For example, during a flight on a commercial airliner, a flight attendant typically offers each passenger a beverage. Many such drinks, especially soft drinks, are customarily served cold. Either the beverage has been refrigerated and/or it is served with a glass or cup filled with ice. When a passenger selects a particular drink, the flight attendant will usually take a plastic cup and fill it with several ice cubes and then pour the requested beverage into the cup. The flight attendant will then hand the cup to the passenger. Sometimes, the flight attendant will also give the passenger the remainder of the bottle or can of beverage so that the passenger can refill their cup at a later time. The most time-consuming part of this entire process is getting the ice out of a relatively large plastic bag, usually a ten pound bag of ice, and depositing several ice cubes into each cup. Furthermore, the large plastic bag of ice is usually torn open and does not include a resealable feature. Therefore, there is no easy way to reseal the partially used bag of ice. In addition, the ice in the large open bag can become contaminated before, during or after transfer of some of the ice cubes to individual cups. This presents a significant health risk to the remaining passengers who may receive ice from the large contaminated bag of ice. Lastly, any unused ice in the large open bag usually has to be disposed of since it is not convenient to save it for a subsequent flight which may take off several hours later.

There are also situations where one or more persons may desire to distribute a small number of liquid drinks to a specific group where only a small quantity of ice is needed. For example, at a tailgate party before a professional football game, a person or a couple may host a tailgate party with a small number of their friends. A cooler is usually present filled with ice cubes and a variety of liquid drinks, such as bottled water, soft drinks, beer, wine, wine coolers, etc. If a guest wishes to add ice to his or her glass, mug or cup prior to adding a beverage, then a separate container or bag of ice is needed since the ice cubes stored in the cooler cannot be used for this purpose. Typically, the ice cubes stored in the cooler have become contaminated by the beverage containers placed in it as well as by other people reaching their hands into the cooler to retrieve a beverage.

Currently, applicant is not aware of any small, individual pouches or bags of ice that are commercially available for individual use and consumption. If such a product was commercially available, it would satisfy a present need and would allow ice to be distributed in a safer and healthier fashion. Should ice in the form of ice cubes, ice chunks, ice pieces, ice nuggets, ice blocks, ice flakes, ice pebbles, crushed ice, shaved ice, ice particles, ice lumps, etc. be available in individual size, pre-packaged flexible containers, one could provide a limited quantity of ice for a beverage in a cost effective, efficient and timely manner.

Now a pre-packaged, flexible container of ice and air has been invented which is capable of providing an individual serving of ice to a given person.

SUMMARY OF THE INVENTION

Briefly, this invention relates to a pre-packaged, flexible container of ice and air. The pre-packaged, flexible container includes a first member having a hermetically sealed outer periphery which encloses a cavity. The cavity has a volume of less than about 25 cubic inches. The pre-packaged, flexible container also includes ice and air contained within the cavity. The ice is present as an individual piece or as multiple pieces. The remainder of the cavity is occupied by air. The air fills at least about 50% of the volume of the cavity. Furthermore, the container, ice and air have a combined weight of less than about 5 ounces.

In another embodiment, the pre-packaged, flexible container of ice and air includes a first member folded upon itself to form a first folded end, a pair of second ends, a pair of side edges, and an outer periphery. A seal is formed about at least a portion of the outer periphery to completely enclose a cavity therein. The cavity has a volume of less than about 20 cubic inches. The pre-packaged, flexible container also includes ice and air contained within the cavity. The ice is present as an individual piece or as multiple pieces. The remainder of the cavity is occupied by air. The air fills more than 50% of the volume of the cavity. Furthermore, the container, ice and air have a combined weight of less than about 4 ounces.

In a third embodiment, the pre-packaged, flexible container of ice and air includes a first member and a second member aligned so as to have a coterminuous outer periphery with a cavity formed therein. The cavity has a volume of less than about 20 cubic inches. A seal is formed about the outer periphery which bonds the first member to the second member and completely encloses the cavity. The pre-packaged, flexible container also includes ice and air contained within the cavity. The ice is present as an individual piece or as multiple pieces. The remainder of the cavity is occupied by air. The air fills at least about 50% of the volume of the cavity. Furthermore, the container, ice and air have a combined weight of less than about 3 ounces.

The general object of this invention is to provide a pre-packaged, flexible container of ice and air. A more specific object of this invention is to provide an individual, pre-packaged, flexible container of ice and air which has a weight of less than about 5 ounces.

Another object of this invention is to provide a pre-packaged, flexible container of ice and air that has a tear strip to facilitate easy opening of the container.

A further object of this invention is to provide a pre-packaged, flexible container of ice and air which is sufficient to cool one individual glass or cup of beverage.

Still another object of this invention is to provide a pre-packaged, flexible container of ice and air which is easy to distribute in an efficient manner.

Still further, an object of this invention is to provide a pre-packaged, flexible container of ice and air which is less susceptible to contamination once the container is opened since the amount of ice is sufficient for only a single drink.

Other objects and advantages of the present invention will become more apparent to those skilled in the art in view of the following description and the accompanying drawings.

DETAILED DESCRIPTION OF THE INVENTION

Figure 3:
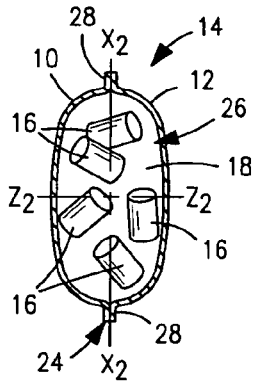
FIG. 3 is a cross-sectional view of the container of ice and air shown in FIG. 2 taken along line 3-3 and depicting a cavity having a volume with multiple ice cubes enclosed therein and air occupying at least about 50% of the volume.

Referring to FIGS. 1-4, a first member 10 and a second member 12 are shown which can be used to construct an individualized, pre-packaged flexible container 14, see FIG. 3. The flexible container 14 is capable of holding and enclosing a small quantity of ice 16 and air 18. By "flexible" it is meant a container formed from a pliable material that is capable of being bent or flexed. The flexible container 14 is not rigid. For example, the flexible container 14 can be a bag, a pouch, a sack, etc. The flexible container 14 is capable of enclosing both ice 16 and air 18 simultaneously. By "ice" it is meant water frozen solid, a mass of frozen water. By "air" it is meant a colorless, odorless, gaseous mixture, mainly nitrogen (approximately 78%) and oxygen (approximate 21%) with lesser amounts of other gases.

The temperature of the ice 16 should be about 320 Fahrenheit (F) or lower. By "Fahrenheit" it is meant a temperature scale that registers the freezing point of water as 32° F. and the boiling point as 212° F. at one atmosphere of pressure. The air 18 which surrounds the ice 16 can vary in temperature depending upon the time and conditions at which the flexible container 14 is stored after being filled with ice 16 and air 18. The air 18 can be at a temperature above, equal to or below 32° F. The air 18 can be at a temperature above 32° F. for a certain period of time before the ice 16 starts to melt. Normally, the air 18 will increase in temperature before the ice 16 starts to melt. Should the ice 16 completely melt into water, it is possible to refreeze the flexible container 14 such that the water contained therein will be transformed back into ice 16. However, in this situation, the ice 16 will be a single individual piece.

The first member 10 has a longitudinal central axis X-X, a transverse central axis Y-Y, and a vertical central axis Z-Z. The first member 10 also has a thickness t measured along the vertical central axis Z-Z. The second member 12 has a longitudinal central axis $X_1$-$X_1$, a transverse central axis $Y_1$-$Y_1$, and a vertical central axis $Z_1$-$Z_1$. The second member 12 also has a thickness $t_1$ measured along the vertical central axis $Z_1$-$Z_1$.

The first member 10 can be formed from a material that is identical, similar to or different from the material used to form the second member 12. Desirably, the first and second members, 10 and 12 respectively, are formed from the same material. The first and second members, 10 and 12 respectively, can be formed from various materials, including but not limited to: plastics, thermoplastics, foil, aluminum foil, cloth, a polyolefin such as polyethylene or polypropylene or a combination thereof. The material can be a woven material, a non-woven material, an extruded material, a thermoformed material, etc. The material can be transparent, semi-transparent, opaque or colored to a desired hue. Desirably, the first and second members, 10 and 12 respectively, are formed from a plastic material that is transparent or semi-transparent. By "transparent" it is meant a material that is capable of transmitting light so that an object or image can be seen as if there were no intervening material. By "semi-transparent" it is meant a material that is capable of transmitting some light so that at least the outline of an object or image can be seen. The first and second members, 10 and 12 respectively, can also be formed from a composite material having two or more layers. One of the layers of the composite can be a vapor barrier layer to prevent the passage of a vapor, a liquid-impermeable layer to prevent the passage of a liquid or fluid, an insulating layer to assist in maintaining the temperature within the container 14, etc. By "liquid" it is meant a state of matter characterized by a readiness to flow, little or no tendency to disperse, and relatively high incompressibility. By "fluid" it is meant a continuous amorphous substance whose molecules move freely past one another and that assumes the shape of its container.

Figure 1:
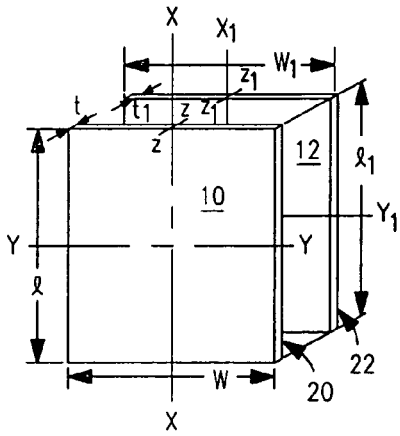
FIG. 1 is a perspective view of first and second members used to construct a flexible container capable of holding ice and air.
Figure 2:
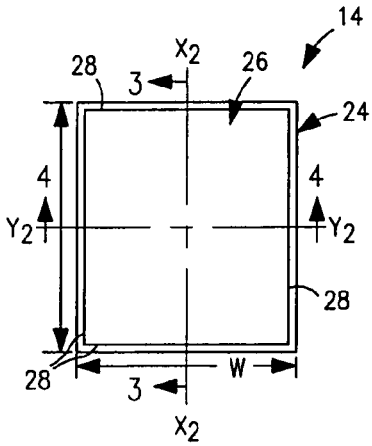
FIG. 2 is a front view of a flexible container for holding ice and air formed by sealing the first and second members, shown in FIG. 1, together.

Referring to FIG. 1, each of the first and second members, 10 and 12 respectively, is depicted as being square in configuration. However, the first and second members, 10 and 12 respectively, can be shaped to any geometrical configuration one desires to utilize. For example, each of the first and second members, 10 and 12 respectively, can be shaped as a rectangle, a triangle, a polygon, etc. The first member 10 has a length l and a width w. The length l dimension can be less than, equal to or be greater than the w dimension. The dimension of the length l and the dimension of the width w should each be equal to or less than about 5 inches. Desirably, the dimension of the length l and the dimension of the width w should each be equal to or less than about 4 inches. More desirably, the dimension of the length l and the dimension of the width w should each be equal to or less than about 3 inches.

The second member 12 has a length $l_1$ and a width $w_1$. The dimension of the length $l_1$ and the dimension of the width $w_1$ should each be equal to or less than about 5 inches. Desirably, the dimension of the length $l_1$ and the dimension of the width $w_1$ should each be equal to or less than about 4 inches. More desirably, the dimension of the length $l_1$ and the dimension of the width $w_1$ should each be equal to or less than about 3 inches. Since each of the first and second members, 10 and 12 are each a square, $l=w$ and $l_1=w_1$. Furthermore, since the first and second members, 10 and 12 respectively, are of equal size, $l=l_1=w=w_1$. Desirably, each of the first and second members, 10 and 12 respectively, has approximately the same size and geometrical configuration. In FIG. 1, each of the first and second members, 10 and 12 respectively, has approximately the same length l and $l_1$ and width w and $w_1$ dimensions. It should be understood that the first and second members, 10 and 12 can be of different sizes and shapes, if desired. However, a more aesthetically pleasing container 14 can be constructed when the first and second members, 10 and 12 respectively, are of approximately the same size and shape.

The first member 10 has a thickness t and the second member 12 has a thickness $t_1$. The thickness t can be greater than, equal to or be less than the thickness $t_1$. Desirably, the thickness t of the first member 10 is equal to the thickness $t_1$ of the second member 12. The thicknesses t and $t_1$ can vary in dimension. The thicknesses t and $t_1$ can range from between about 0.5 millimeter to about 10 millimeters. Desirably, the thicknesses t and $t_1$ can range from between about 1 millimeter to about 5 millimeters. More desirably, the thicknesses t and $t_1$ can range from between about 1.5 millimeters to about 4 millimeters. Even more desirably, the thicknesses t and $t_1$ can range from between about 2 millimeters to about 3 millimeters. Most desirably, the thicknesses t and $t_1$ are less than about 3 millimeters.

Still referring to FIGS. 1-4, the first member 10 has an outer periphery 20 and the second member 12 has an outer periphery 22, see FIG. 1. By "periphery" it is meant a line that forms the boundary of an area; a perimeter. The first and second members, 10 and 12 respectively, are overlapped or aligned so that the flexible container 14 has a coterminuous outer periphery 24, see FIG. 2. By "coterminuous" it is meant sharing a boundary; contiguous, contained in the same boundary. The flexible container 14 further has a cavity 26 enclosed within the outer periphery 24, see FIG. 3. By "cavity" it is meant a hollow area within a body. The cavity 26 has a volume of less than about 25 cubic inches so as to provide an individual serving of ice 16 to a person. Desirably, the cavity 26 has a volume is less than about 20 cubic inches. More desirably, the cavity 26 has a volume of between about 5 cubic inches to about 20 cubic inches. Even more desirably, the cavity 26 has a volume of less than about 19 cubic inches. By "volume" it is meant the amount of space occupied by a three-dimensional object or region of space; the capacity of such a region or of a specified container.

Referring again to FIGS. 2-4, the flexible container 14 has a longitudinal central axis $X_2$-$X_2$, a transverse central axis $Y_2$-$Y_2$ and a vertical central axis $Z_2$-$Z_2$, see FIG. 3. The flexible container 14 also has a seal 28 formed about the outer periphery 24. Desirably, the seal 28 extends completely around the outer periphery 24. Stated another way, the seal 28 extends 360 degrees about the outer periphery 24. The seal 28 can be formed inside of the outer periphery 24 and be spaced apart from the outer periphery 24 or it can be formed inside of the outer periphery 24 and extend to the outer periphery 24. The seal 28 functions to bond the first member 10 to the second member 12. The seal 28 can be a hermetical seal. By "hermetical" it is meant completely sealed against the escape or entry of air, impervious to outside interference or influence. The seal 28 completely encloses the cavity 26 once it is formed. The seal 28 can be formed by various means, including but not limited to using: heat, pressure, heat and pressure, ultrasonic energy, or other means known to those skilled in the art. The seal 28 can also be formed by applying or depositing an adhesive, glue, a co-adhesive, etc. between the first and second members, 10 and 12 respectively.

Before the cavity 26 is completely enclosed by the seal 28, one or more pieces of the ice 16 and the air 18 is inserted into the cavity 26. Various methods of inserting the ice 16 into a partially formed cavity 26 can be employed. For example, the cavity 26 can be partially sealed by the seal 28 such that from about 50% to about 90% of the cavity 26 is enclosed by the seal 28. Desirably, about 50% to about 80% the cavity 26 is initially sealed by the seal 28. More desirably, about 50% to about 75% the cavity 26 is initially sealed by the seal 28. Even more desirably, about 55% to about 75% the cavity 26 is initially sealed by the seal 28.

The ice 16 can be in the form of a single, individual piece of ice 16 or it can consist of two or more individual pieces. Desirably, multiple individual pieces of ice 16 will be present. The ice 16 can be in various shapes and sizes. For example, the ice 16 can be in the form of ice cubes, ice chunks, ice nuggets, small ice blocks, ice pebbles, ice particles, ice lumps, ice flakes, briquettes, crushed ice, shaved ice, etc.

Figure 4:
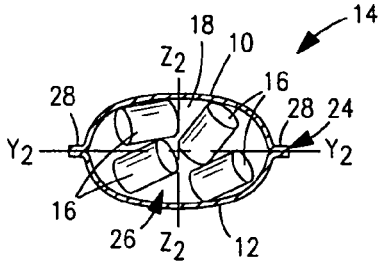
FIG. 4 is a cross-sectional view of the container of ice and air shown in FIG. 2 taken along line 4-4 and depicting a cavity having a volume with multiple ice cubes enclosed therein and air occupying at least about 50% of the volume.

Referring to FIGS. 3 and 4, the ice 16 is depicted as being in the form of several ice cubes. Each ice cube has a maximum dimension of less than about 1.5 inches. Each ice cube is about 1 inch by about 1 inch by about 1.25 inches in dimension. Alternatively, each ice cube can have a maximum dimension of less than about 1 inch. Desirably, each ice cube has a maximum dimension of less than about 0.9 inches.

The shape of the ice 16 can vary. The ice 16 can be constructed as a 3-dimensional ice cube having a height, a width and a length. However, an ice cube can have almost any desired geometrical shape or configuration including but not limited to a sphere, a cylindrical, a square cube, a rectangular cube, a polygon shaped cube, etc. The overall shape of any of the ice cubes can be regular or irregular. In FIG. 3, the ice 16 is depicted as being five individual ice cubes. In FIG. 4, the ice 16 is depicted as being four individual ice cubes.

It should be understood that the ice 16 can be one or more individual pieces, such as one or more ice cubes, ice chunks, ice nuggets, ice lumps, etc. Alternatively, the ice 16 can be in the form of a plurality of ice pebbles or ice flakes. Still further, the ice 16 can consist of a large quantity of shaved or crushed ice.

When the ice 16 is shaped as a single ice piece, it can have a weight ranging from between about 0.1 ounces to about 5 ounces. Desirably, a single piece of ice 16 can vary in weight from between about 0.2 ounces to about 1 ounce. More desirably, a single piece of ice 16 can vary in weight from between about 0.35 ounces to about 0.45 ounces. Since two or more pieces of ice 16 can be housed in the cavity 26, the total weight of the ice 16 can range from between about 0.1 ounces to about 5 ounces. Desirably, the total weight of the ice 16 can range from between about 2 ounces to about 5 ounces. More desirably, the total weight of the ice 16 can range from between about 2.5 ounces to about 5 ounces. Even more desirably, the total weight of the ice 16 can range from between about 3 ounces to about 5 ounces.

Alternatively, one can insert water into the cavity 26 and the cavity 26 can be sealed. The water is then frozen into ice 16. The ice 16 can be broken or chopped into smaller pieces.

Still referring to FIGS. 3 and 4, the air 18 occupies at least about 50% of the volume of the cavity 26. Desirably, the air 18 occupies more than 50% of the volume of the cavity 26. More desirably, the air occupies from between about 55% to about 75% of the volume of the cavity 26. Even more desirably, the air occupies from between about 55% to about 70% of the volume of the cavity 26. Still more desirably, the air occupies from between about 55% to about 65% of the volume of the cavity 26. Most desirably, the air occupies from between about 55% to about 60% of the volume of the cavity 26.

The air 18 can be inserted into the cavity 26 before, during or after the ice 16 is inserted into the cavity 26. The air 18 should be introduced into the cavity 26 before the seal 28 completely seals the cavity 26. For example, the air 18 can be inserted into the cavity 26 simultaneously or sequentially with the introduction of the ice 16 while the seal 28 encloses from between about 50% to about 90% of the cavity 26. The air 18 can be introduced at atmospheric pressure or at a pressure above atmospheric pressure. By "atmospheric pressure" it is meant a unit of pressure equal to the air pressure at sea level, approximately equal to $1.01325\times10^5$ Pascal's. The air 18 can be introduced into the cavity 26 at or above atmospheric pressure. Desirably, the air 18 is introduced into the cavity 26 at a pressure ranging from between 0 pounds per square inch (psi) to about 1 psi. More desirably, the air 18 is introduced into the cavity 26 at a pressure ranging from between about 0.1 psi to about 0.5 psi. Even more desirably, the air 18 is introduced into the cavity 26 at a pressure of less than about 0.5 psi.

The air 18 can be below, at or be above room temperature. Desirably, the air 18 that is introduced into the cavity 26 is at or below 40° F. More desirably, the air 18 that is introduced into the cavity 26 is at or below 32° F. Even more desirably, the air 18 that is introduced into the cavity 26 ranges from between about 10° F. and about 32° F.

The pre-packaged, flexible container 14, the ice 16 and the air 18 should have a combined weight of less than about 5 ounces. This weight includes the weight of the first and second members, 10 and 12 respectively, any additional material used to form the seal 28, the weight of the ice 16 and the air 18, as well as any label or printing added to the flexible container 14. Desirably, the pre-packaged, flexible container 14, the ice 16 and the air 18 has a combined weight of from between about 1 ounce to about 5 ounces. More desirably, the pre-packaged, flexible container 14, the ice 16 and the air 18 has a combined weight of less than about 4 ounces. Even more desirably, the pre-packaged, flexible container 14, the ice 16 and the air 18 has a combined weight of less than about 3.5 ounces. Most desirably, the pre-packaged, flexible container 14, the ice 16 and the air 18 has a combined weight of at least about 3 ounces.

The reason the flexible container 14, the ice 16 and the air 18 has a predetermined combined weight is to allow it to function as a single, individual serving of ice for one drink. The amount of ice 16 in the flexible container 14 can vary depending upon the physical size of the glass or cup it is to placed or dispense into. For example, the glass or cup can be sized to hold from between about 4 ounces to about 24 ounces of fluid. Most likely, the glass or cup will hold 4, 8, 12 or 16 ounce of fluid. By restricting the flexible container 14, the ice 16 and the air 18 to a certain combined weight, one can be assured that the ice 16 contained therein has a very low probability of becoming contaminated once the flexible container 14 is opened. In addition, all of the ice 16 enclosed in the flexible container 14 can be easily dispensed and will fit within a glass or cup designed to hold a predetermined amount of a fluid. The flexible container 14 can be sized to hold sufficient ice 16 for a 4-16 ounce drink. By "drink" it is meant any one of various liquids or fluids that a human or animal can safely consume, including but not limited to: water, carbonated water, a carbonated drink such as a soda or pop, a non-carbonated drink such as a juice, tea, coffee, a non-alcoholic drink, and an alcoholic drink such as beer, wine, wine coolers, whiskey, brandy, vodka, liqueur, etc. Certain liquid medicines, for example a cough syrup, will also fit within the definition of a drink.

Figure 5:
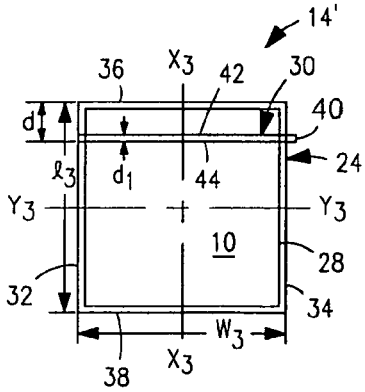
FIG. 5 is a front view of an alternative embodiment of a container of ice and air having a tear strip extending horizontally across the container.

Referring now to FIG. 5, an alternative pre-packaged, flexible container 14' is shown. The flexible container 14' is similar to the flexible container 14, shown in FIGS. 1-4, except that it includes a tear strip 30. The flexible container 14' has a longitudinal central axis $X_3$-$X_3$ and a transverse central axis $Y_3$-$Y_3$. The flexible container 14' also has a length $l_3$ and a width $w_3$. The tear strip 30 facilitates opening the container 14' so that the ice 16 can be easily removed. The flexible container 14' is formed from a first member 10 and a second member 12 (not shown). The flexible container 14' is square in configuration having a first side 32, a second side 34 aligned opposite to the first side 32, a third side 36 aligned perpendicular to the first side 32, and a fourth side 38 aligned opposite to the third side 36. Desirably, each of the sides 32, 34, 36 and 38 has a dimension equal to or of less than about 5 inches. More desirably, each of the sides 32, 34, 36 and 38 has a dimension equal to or of less than about 4 inches. Even more desirable, at least two of the sides 32 and 34, or 36 and 38, have a dimension equal to or of less than about 3 inches.

The tear strip 30 can have various configurations and can be constructed out of various materials. For example, the tear strip 30 can be formed from the same material from which the first member 10 is formed or it can be formed from a different material. As depicted, the tear strip 30 includes a separate strip of material that extends completely across the first member 10 from the first side 32 to the second side 34. The tear strip 30 also includes a finger tab 40 which is integral with the tear strip 30. The finger tab 40 extends outward beyond the second side 34. The finger tab 40 functions to permit a person to grasp the finger tab 40 between his or her thumb and forefinger and pull the tear strip 30 back and away from the second side 34 of the first member 10. In so doing, the tear strip 30 will separate from the first member 10 and cause an opening to be formed in the flexible container 14'.

The tear strip 30 can be positioned anywhere along the length $l_3$ of the first side 32. However, it has been found that by placing the tear strip 30 closer to one end of the length $l_3$, for example, near the third side 38, that it very easy to dispense or remove the ice 16 from the flexible container 14' once the tear strip 30 is torn open. As indicated in FIG. 5, the tear strip 30 is spaced a distance d away from the third side 38. The distance d should be 1 inch or less as measured from the third side 38. Desirably, the distance d is equal to or less than about 0.5 inches as measured from the third side 38. Even more desirably, the distance d is equal to or less than about 0.4 inches as measured from the third side 38. Most desirably, the distance d is equal to or less than about 0.25 inches as measured from the third side 38.

The tear strip 30 can be aligned parallel to the third side 36 or be formed at an angle thereto. In addition, the tear strip 30 can be a linear line or a non-linear line. Furthermore, the tear strip 30 could be an arcuate or curved line, or have a desired geometrical shape, such as a sinusoidal wave, a zigzag shape, etc.

It should be understood that even though the tear strip 30 has been described as being formed in the first member 10, it could alternatively be formed in the second member 12, or be formed in both of the first and second members, 10 and 12 respectively. It should also be understood that the tear strip 30 can vary in construction and the way it is applied to the flexible container 14'. In FIG. 5, the tear strip 30 includes a pair of weakened lines 42 and 44 formed in the first member 10. The pair of weakened lines 42 and 44 is aligned parallel to one another and is separated by a distance $d_1$. The distance $d_1$ of the tear strip 30 can vary but typically is equal to or less than about 0.125 inches. Desirably, the distance $d_1$ of the tear strip 30 is equal to or less than about 0.1 inches. More desirably, the distance $d_1$ of the tear strip 30 is equal to or less than about 0.05 inches.

It should further be understood that once the tear strip 30 is completely removed from the opened flexible container 14', that it should be properly discarded in a trash receptacle. Alternatively, it is possible to construct the tear strip 30 such that one end, for example, the end located adjacent to the first side 32, does not separate from the first member 10 and therefore stays attached or connected to the flexible container 14'. This eliminates the need to separately dispose of the tear strip 30.

Figure 6:
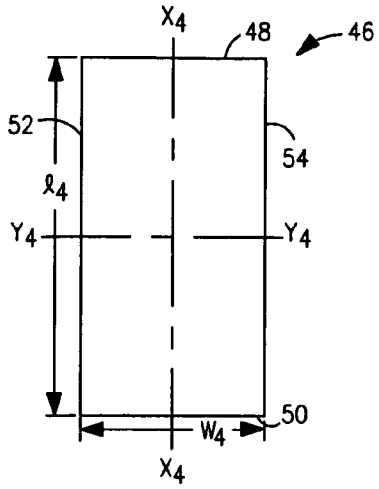
FIG. 6 is a front view of a rectangular first member.

Referring now to FIG. 6, a first member 46 is shown having a rectangular configuration. The first member 46 has a longitudinal central axis $X_4$-$X_4$ and a transverse central axis $Y_4$-$Y_4$. The first member 46 has a first end 48, a second oppositely aligned end 50, a first side 52 and an oppositely aligned side 54. The first member 46 also has a length $l_4$, and a width $w_4$. The length $l_4$ can vary in dimension but desirably is equal to or less than about 12 inches. Desirably, the length $l_4$ is less than about 11 inches. More desirably, the length $l_4$ is less than about 10 inches. The width $w_4$ can also vary in dimension but is equal to or less than about 5 inches in dimension. Desirably, the width $w_4$ is less than about 4 inches. More desirably, the width $w_4$ is less than about 3 inches. The first member 46 can be made from any of the materials described above for constructing the first and/or second members, 10 and 12 respectively.

Figure 7:
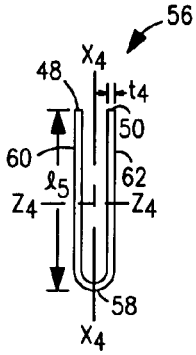
FIG. 7 is a side view of the first member shown in FIG. 6 after it has been folded along its transverse central axis Y-Y.

Referring to FIG. 7, the first member 46 is folded in half about its transverse central axis $Y_4$-$Y_4$ to form a U-shaped member 56 having a first folded end 58 and a pair of second ends 48 and 50. The U-shaped member 56 has a pair of spaced apart, upstanding legs 60 and 62. Each upstanding leg 60 and 62 has a length $l_5$ and a thickness $t_4$. The length $l_5$ can be equal to or be less than about 5 inches. Desirably, the length $l_5$ is equal to or less than about 4 inches. More desirable, the length $l_5$ is equal to or less than about 3 inches. The thickness $t_4$ of each of the upstanding legs 60 and 62 can be equal to or be less than about 10 mm. Desirably, the thickness $t_4$ is equal to or less than about 5 mm. More desirably, the thickness $t_4$ can be equal to or less than about 4 mm. Even more desirably, the thickness $t_4$ is equal to or less than about 3 mm.

Figure 8:
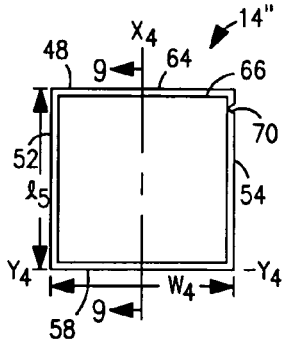
FIG. 8 is a front view of container formed from the folded first member shown in FIG. 7 after it has been sealed along the opposite side edges and along a pair of second ends.
Figure 9:
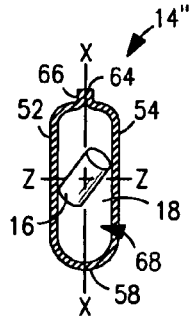
FIG. 9 is a cross-sectional view of the container shown in FIG. 8 taken along line 9-9 and depicting a cavity having a volume with a single ice cube enclosed therein and air occupying more than 50% of the volume.

Referring now to FIGS. 8-9, the folded U-shaped member 56 can be formed into still another embodiment of a pre-packaged, flexible container 14". The flexible container 14" is designed to hold both the ice 16 and the air 18. The flexible container 14" has a pair of sides 52 and 54 and an outer periphery 64. A seal 66 is formed about at least a portion of the outer periphery 64 and cooperates with the first folded end 58 to completely enclose a cavity 68 therein, see FIG. 9. In FIG. 9, the seal 66 extends about 75% around the cavity 68 and the first folded end 58 forms the remaining 25% of the outer periphery 64. The cavity 68 has a volume of less than about 20 cubic inches so that an individual serving of the ice 16 can be provided to a person. Desirably, the cavity 68 has a volume of from between about 5 cubic inches to about 20 cubic inches. More desirably, the cavity 68 has a volume of less than about 19 cubic inches. Even more desirably, the cavity 68 has a volume of less than about 18 cubic inches.

The cavity 68 contains both the ice 16 and the air 18. The ice 16 can be in the form of a single individual piece, such as an ice cube, or be multiple pieces of ice. The air 18 occupies at least about 50% of the volume of the cavity 68. Desirably, the air 18 occupies more than 50% of the volume of the cavity 68 as was explained above with reference to the flexible container 14. More desirably, the air occupies from between about 55% to about 75% of the volume of the cavity 68. The flexible container 14", the ice 16 and the air 18 have a combined weight of about 5 ounces or less. Desirably, the flexible container 14", the ice 16 and the air 18 have a combined weight of less than about 4 ounces. More desirably, the flexible container 14", the ice 16 and the air 18 have a combined of less than about 3 ounces.

Still referring to FIG. 8, a notch 70 is formed partially through the seal 66 at the side 54 to facilitate opening the flexible container 14". The notch 70 is depicted as having a V-shape although it could be constructed to have almost any desired shape. For example, the notch 70 could have any desired geometrical shape, such as a U, a rectangle, a semicircle, etc. Furthermore, the notch 70 could alternatively be formed in the side 52.

Figure 10:
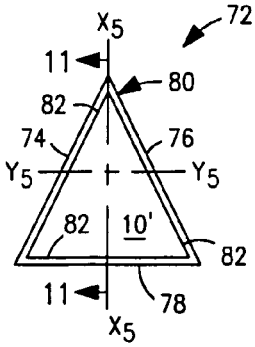
FIG. 10 is a front view of a container having a triangular shape with a seal extending completely about its outer periphery.
Figure 11:
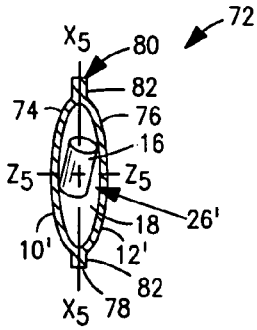
FIG. 11 is a cross-sectional view of the container of ice and air shown in FIG. 10 taken along line 11-11 and depicting a cavity having a volume with a single ice cube enclosed therein and air occupying at least about 50% of the volume.

Referring now to FIGS. 10 and 11, still another embodiment of a pre-packaged, flexible container 72 is depicted. The individual, flexible container 72 is in the form of a triangle having a longitudinal central axis $X_5$-$X_5$, a transverse central axis $Y_5$-$Y_5$ and a vertical central axis $Z_5$-$Z_5$, see FIG. 11. The flexible container 72 is constructed from a first member 10' and a second member 12', see FIG. 11. The flexible container 72 also has a first side 74, a second side 76 and a third side 78. Each of the three sides 74, 76 and 78 are aligned at an acute angle between two adjacent sides to form a triangular configuration. Each of the sides 74, 76 and 78 can have the same dimension or one or more of the sides 74, 76 and 78 can vary in dimension. Desirably, each of the three sides 74, 76 and 78 can have a dimension of about 5 inches or less. More desirably, each of the three sides 74, 76 and 78 can have a dimension of about 4.5 inches or less. Even more desirably, at least two of the three sides 74, 76 and 78 have a dimension of less than about 4.5 inches.

The flexible container 72 also has an outer periphery 80 and a seal 82 formed about the outer periphery 80. The seal 82 secures the first member 10' to the second member 12'. Desirably, the seal 82 extends completely around the outer periphery 80. Stated another way, the seal 82 extends 360 degrees about the outer periphery 80. The seal 82 can be formed inside of the outer periphery 80 and be spaced apart from the outer periphery 80 or it can be formed inside of the outer periphery 80 and extend to the outer periphery 80. The seal 82 can be a hermetical seal. The seal 82 completely encloses a cavity 26', see FIG. 11, once it is formed. The seal 82 can be formed by various means, including but not limited to: using heat, pressure, heat and pressure, ultrasonic energy or any other method known to those skilled in the art. The seal 82 can also be formed by applying or depositing an adhesive, glue, a co-adhesive, etc. between the first and second members, 10' and 12' respectively.

The ice 16 and air 18 can be introduced or inserted into the cavity 26' in a similar fashion as was described above with reference to cavity 26. In FIG. 11, the ice 16 is depicted as a single ice cube. The single ice cube can have a maximum dimension of about 2 inches or less and a minimum dimension of greater than 0.25 inches. Desirably, multiple pieces of ice 16, each in the form of an ice cube, are present in the cavity 26'.

Method of Forming a Pre-Packaged, Flexible Container of Ice and Air

Three alternative methods of forming a pre-packaged, flexible container 14, 14', 14" or 72 which is capable of housing an individualized serving of ice 16 will now be explained with reference to FIGS. 12-14. For discussion purposes only, the method will be described referring to the flexible container 14. However, it should be understood that the method could be used with the flexible container 14', 14" or 72.

Figure 12:
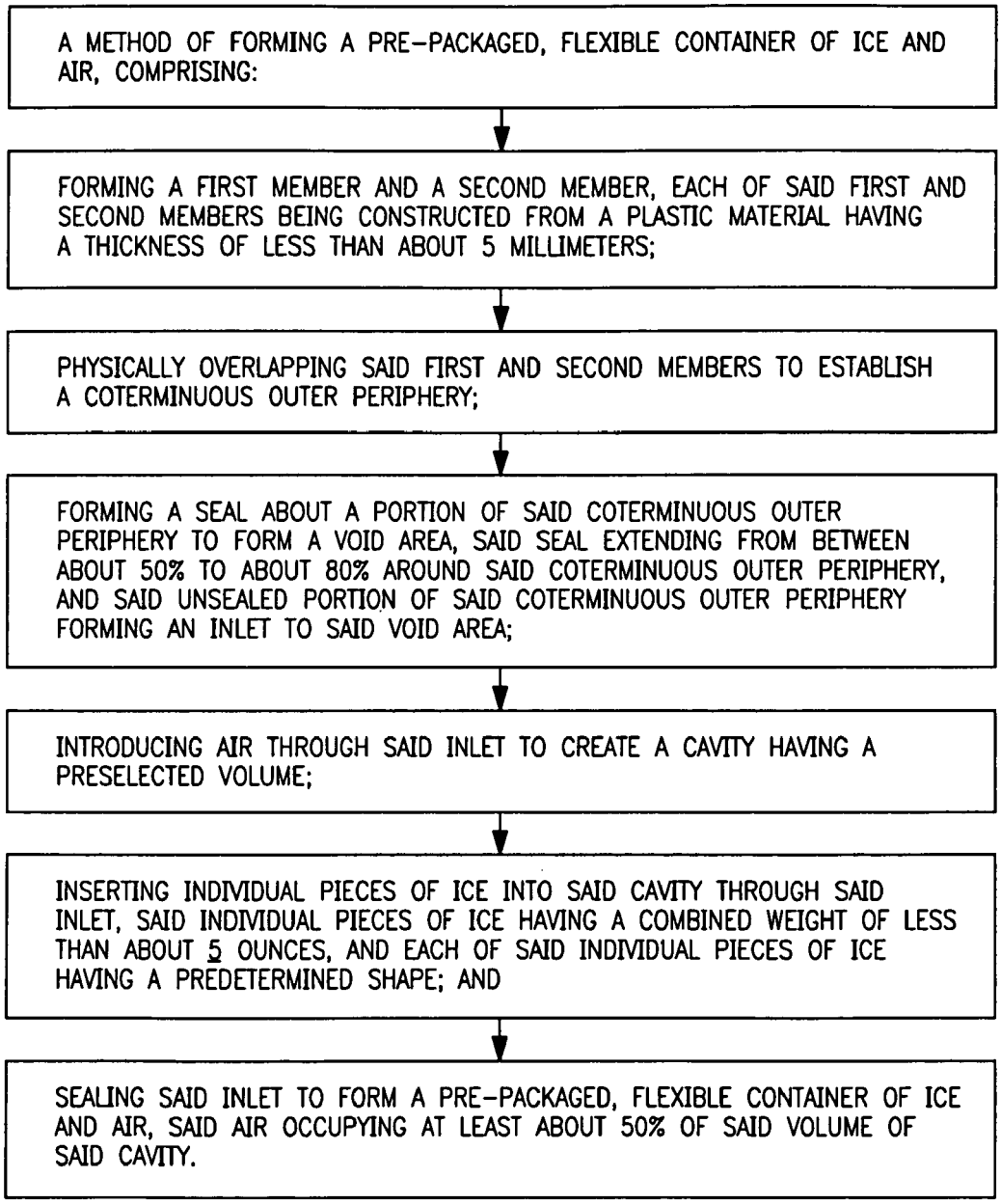
FIG. 12 is a flow diagram of a method of forming a pre-packaged, flexible container of ice and air.

In FIG. 12, a flow diagram is depicted. The method of forming the flexible container 14 includes the steps of starting with a first member 10 and a second member 12. Each of the first and second members, 10 and 12 respectively, are of approximately the same size and configuration, although they do not have to be. The first and second members, 10 and 12 respectively, can be formed from various materials. Desirably, the first and second members, 10 and 12 respectively, are formed from a plastic material, such as a thermoplastic. Polyethylene and polypropylene are two thermoplastic materials that work well. Each of the first and second members, 10 and 12 respectively, has a thickness $t_1$ and $t_2$ respectively. The thicknesses $t_1$ and $t_2$ can be the same dimension or be of a different dimension. The thicknesses $t_1$ and $t_2$ should be less than about 10 mm. Desirably, each of the thicknesses $t_1$ and $t_2$ is less than about 5 mm. More desirably, each of the thicknesses $t_1$ and $t_2$ is less than about 4 mm. Even more desirably, each of the thicknesses $t_1$ and $t_2$ is less than about 3 mm. Most desirably, each of the thicknesses $t_1$ and $t_2$ is less than about 2 mm.

The first and second members, 10 and 12 respectively, each have an outer periphery, 20 and 22 respectively. The first and second members, 10 and 12 respectively, are physically overlapped one upon the other such that a coterminuous outer periphery 24 is established. The first member 10 can be positioned above the second member 12, or alternatively, the second member 12 can be positioned above the first member 10.

A seal 28 is then forming about at least a portion of the coterminuous outer periphery 24 to partially enclose a cavity or void area 26 within the flexible container 14. The seal 28 can be formed using heat, pressure, heat and pressure, ultrasonic energy or any other method known to those skilled in the art. In addition, the seal 28 can be formed by using an adhesive, glue, a co-adhesive, etc. The seal 28 can hermetically seal the first and second members, 10 and 12 respectively, together. The seal 28 can initially extend around from between about 50% to about 90% of the coterminuous outer periphery 24. The seal 28 will eventually enclose the entire cavity 26 after the ice 16 and the air 18 is introduced into the cavity 26. Desirably, the seal 28 will initially extend around from between about 50% to about 80% of the coterminuous outer periphery 24. More desirably, the seal 28 will initially extend around from between about 50% to about 75% of the coterminuous outer periphery 24. Even more desirably, the seal 28 will initially extend around from between about 55% to about 70% of the coterminuous outer periphery 24.

The initially, unsealed portion defines an inlet to the void area of the cavity 26. The unsealed portion or inlet can extend from between about 10% to about 50% around the coterminuous outer periphery 24. Desirably, the unsealed portion or inlet extends from between about 20% to about 50% around the coterminuous outer periphery 24. More desirably, the unsealed portion or inlet extends from between about 25% to about 50% around the coterminuous outer periphery 24. Even more desirably, the unsealed portion or inlet extends from between about 30% to about 45% around the coterminuous outer periphery 24.

The air 18 is introduced through the unsealed portion or inlet to create a cavity 26 having a preselected volume. The volume is less than about 20 cubic inches so as to enclose an individualize serving of ice 16. Desirably, the volume is less than about 19 cubic inches. More desirably, the volume is less than about 18 cubic inches. Even more desirably, the volume of the cavity 26 ranges from between about 5 cubic inches to about 20 cubic inches.

The air 18 can be introduced at atmosphere pressure or be introduced at above atmospheric pressure into the void area of the cavity 26. For example, the air 18 can be introduced at a pressure from between 0 psi to about 1 psi. Alternatively, the air 18 can be introduced at a pressure of about 0.5 psi or less.

The first and second members, 10 and 12 respectively, can be manipulated, if needed, to distort the void area of the cavity 26 so as to allow the air 18 to pass into it through the unsealed portion or inlet. For example, the first and second members, 10 and 12 respectively, can be moved towards one another to form a void area therebetween which the air 18 can occupy. Alternatively, the first and second members, 10 and 12 respectively, can be flexed, shaken or be pulled apart to form a void area therebetween which the air 18 can occupy.

One or more individual pieces of ice 16 can be inserted into the cavity 26 through the inlet. Each individual piece of ice 16 can have a weight ranging from between about 0.001 ounces to about 1 ounce. The multiple, individual pieces of ice 16 can have a weight of from between about 1 ounce to about 5 ounces. Desirably, the multiple, individual pieces of ice 16 can have a weight of from between about 2 ounces to about 5 ounces. More desirably, the multiple, individual pieces of ice 16 can have a weight of from between about 3 ounces to about 4.5 ounces. Even more desirably, the multiple, individual pieces of ice 16 can have a weight of from between about 3.5 ounces to about 4 ounces. The weight of the ice 16 can be matched to the size of glass or cup the ice 16 is designed to be placed or dispensed into. It should be understood that the ice 16 dispended into a particular glass or cup may not entirely fill that glass or cup. Instead, the amount of ice 16 dispensed into a particular glass or cup should be sufficient to cool the liquid or fluid the glass or cup is designed to hold. For example, 1-4 normal size ice cubes, each having a weight of from between about 0.35 ounces to about 0.45 ounces, may be sufficient to cool a drink poured into a 4 or 6 ounce glass or cup. Likewise, 2-6 normal size ice cubes, each having a weight of from between about 0.35 ounces to about 0.45 ounces, may be sufficient to cool a drink poured into an 8 or 12 ounce glass or cup. By a "normal size ice cube" it is meant an ice cube having a maximum dimension of about 1.5 inches. A normal size ice cube measures roughly about 1 inch by about 1 inch by about 1.25 inches.

The individual pieces of ice 16 can have a predetermined shape or they can be randomly shaped. Each of the individual pieces of ice 16 can have approximately the same shape or each can vary in shape. The ice 16 can be introduced at the same time as the air 18 or the ice 16 can be introduced before or after the air 18 is inserted. Desirably, some air 18 is first inserted to enlarge the void area of the cavity 26 before the ice 26 is inserted.

The unsealed portion or inlet is then sealed to form a completely enclosed cavity 26 containing the ice 16 and at least about 50% of the air 18. The unsealed portion or inlet can be sealed using the same or a different type or kind of seal 28 as was used to form the seal 28. Desirably, the seal 28 covering the inlet is identical to the seal 28 surrounding the remainder of the outer periphery 24. The pre-packaged, flexible container 14 of the ice 16 and the air 18 is sized for an individual serving of ice into a glass or cup. The glass or cup can be formed from various materials, including but not limited to: glass, crystal, china, paper, wax paper, foam, plastic, clear plastic, metal, tin, aluminum, etc. The glass or cup can be sized to hold a predetermined amount of liquid or fluid. For example, the glass or cup can be sized to hold from about 1 to about 24 ounces of a liquid or fluid. The air 18 retained in the cavity 26 of the pre-packaged, flexible container 14 should occupy at least about 50% of the volume of the cavity 26. Desirably, the air 18 will occupy more than 50% of the volume of the container 14.

The temperature of the air 18 within the cavity 26 can vary. The temperature of the air 18 can be below 32° F., be approximately equal to 32° F., or be above 32° F. Desirably, the temperature of the air 18 within the cavity is at or below 32° F. when the flexible container 14 is filled. The temperature of the air 18 within the flexible container 14 can change as the environment surrounding the flexible container 14 changes.

Figure 13:
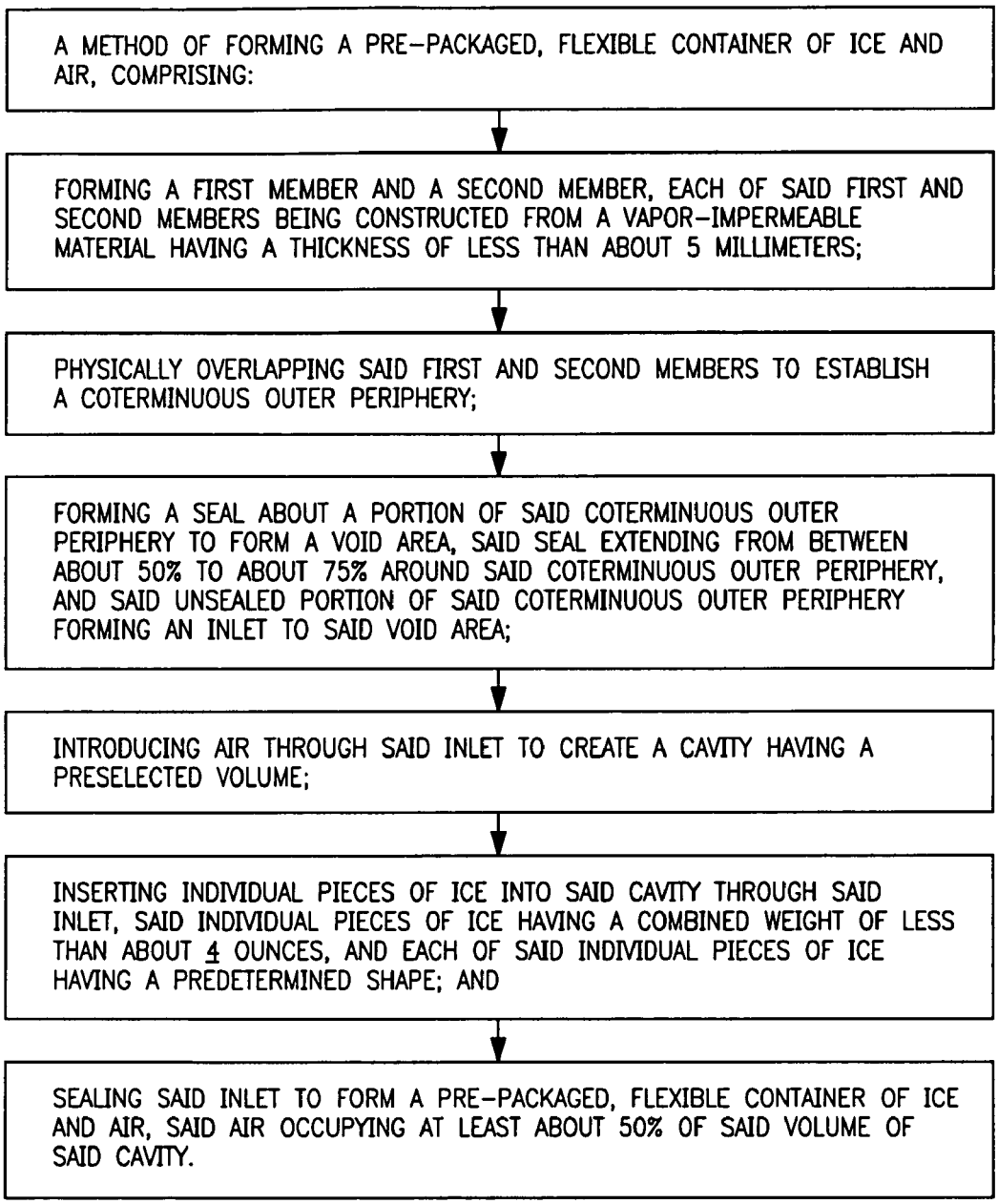
FIG. 13 is a flow diagram of an alternative method of forming a pre-packaged, flexible container of ice and air.

Referring to FIG. 13, an alternative method of forming a pre-packaged, flexible container 14 is shown in the flow diagram. In this method, each of the first and second members, 10 and 12 respectively, are constructed from a vapor-impermeable material. The vapor-impermeable material will prevent or limit vapor within the flexible container 14 from escaping. The vapor-impermeable material will also prevent outside vapors from permeating into the flexible container 14. In addition, this method teaches that the seal 28 initially extends from between about 50% to about 80% around the coterminuous outer periphery 24 and the unsealed portion or inlet extends from about 10% to about 50% around the coterminuous outer periphery 24.

The method of forming a pre-packaged, flexible container 14 can also include a tear strip 30. The tear strip 30 can be formed in the first member 10, see FIG. 5, be formed in the second member 12, or be formed in both of the first and second members, 10 and 12 respectively. The tear strip 30 functions to facilitate easy opening of the individual, flexible container 14. The tear strip 30 can optionally include a first end in the form of a finger tab 40, which extends beyond the coterminuous outer periphery 24. The finger tab 40 provides a good way for a person to grasp one end of the tear strip 30 and rip or tear it from the flexible container 14. As the tear strip 30 is torn away, an opening will be formed in the flexible container 14 through which the ice 16 can be easily dispensed or removed. For example, the ice 16 can be dumped or individually removed from the opened flexible container 14. It is anticipated that all of the ice 16 housed within the flexible container 14 will be dispensed at one time but it does not have to be.

It is also possible to form a notch 70, such as the V-shaped notch 70, see FIG. 8, in the coterminuous outer periphery 24. The V-shaped notch 70 will facilitate opening the container 14 in order to remove the ice 16.

Figure 14:
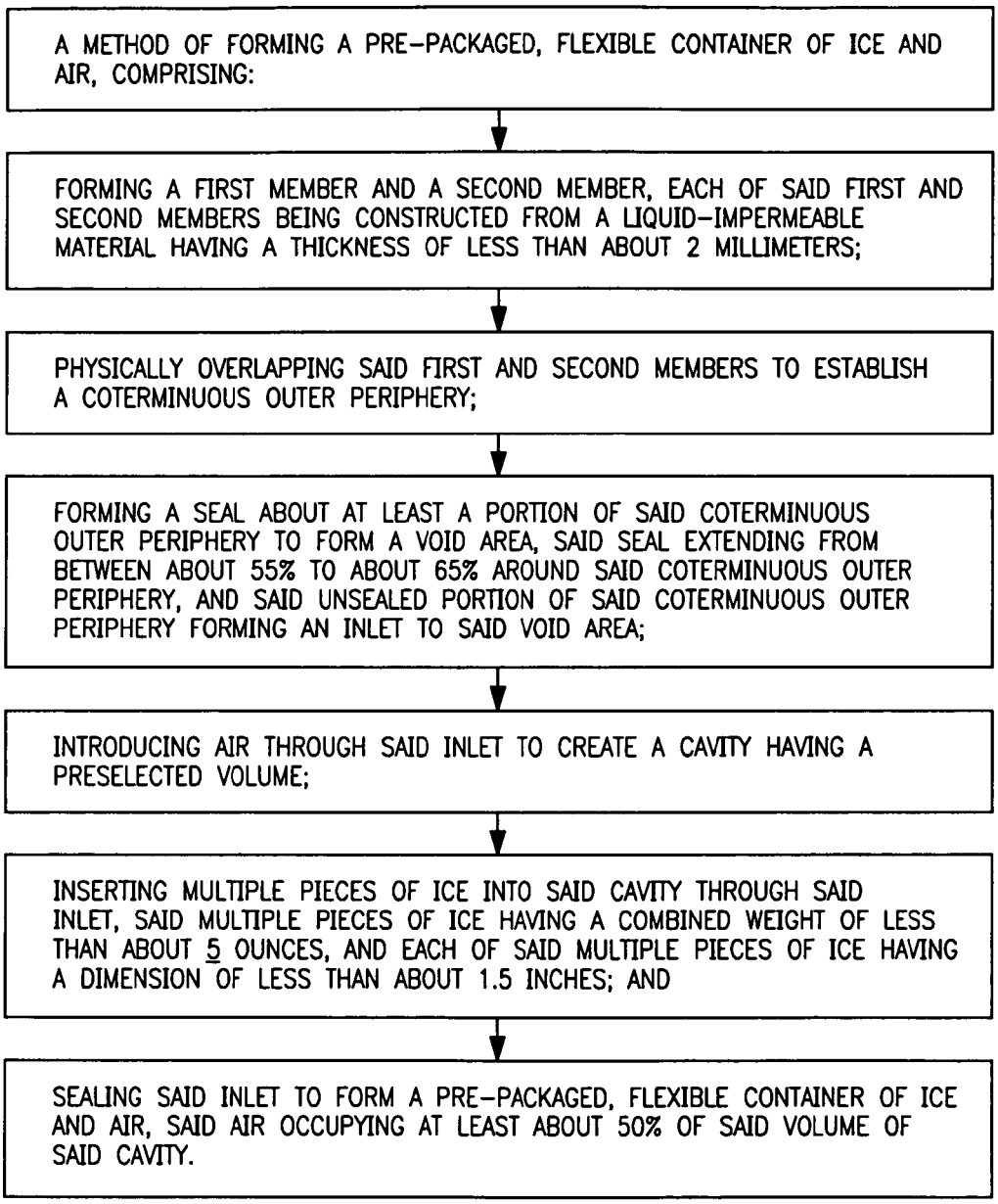
FIG. 14 is a flow diagram of still another method of forming a pre-packaged, flexible container of ice and air.

Referring now to FIG. 14, a third method of forming a pre-packaged, flexible container 14 is depicted in the flow diagram. In this method, each of the first and second members, 10 and 12 respectively, are constructed from a liquid-impermeable material. The liquid-impermeable material can be made from polyethylene, polypropylene or a combination thereof. The liquid-impermeable material will prevent or limit liquid within the cavity 26 of the flexible container 14 from escaping. Likewise, it will prevent a liquid which contacts the outer surface of the flexible container 14 from getting into the cavity 26.

This method also teaches that the seal 28 initially extends from between about 50% to about 75% around the coterminuous outer periphery 24. This will allow for a larger inlet so that it is easier to insert the ice 16 into the cavity 26. In addition, this method teaches that the air 18 occupies more than 50% of the volume of the cavity 26. Desirably, the air 18 occupies from between about 55% to about 75% of the volume of the cavity 26. More desirably, the air 18 occupies from between about 55% to about 65% of the volume of the cavity 26. Even more desirably, the air 18 occupies from between about 55% to about 60% of the volume of the cavity 26.

Furthermore, the method depicted in FIG. 14 describes that each of the multiple pieces of ice 16 has a dimension of less than about 1.5 inches. Ice 16 of this size or smaller will easily fit in a glass or cup having a capacity of about 4-12 ounces. The ice 16 can be formed into various shapes and configurations. Desirably, the ice 16 is in the form of one or more ice cubes because ice cubes tend to last longer in a warm environment then multiple smaller pieces of ice. The ice cube can have at least one dimension that has a maximum dimension of less than about 1 inch. More desirably, the ice 16 is in the form of one or more ice cubes each having at least one dimension that has a maximum dimension of less than about 0.9 inches.

Optionally, the flexible container 14 can be formed from a thermoplastic material having two or more layers. One of the layers can be an insulating layer which can assist in maintaining the cool temperature within the cavity 26. The insulating layer can be formed from an insulating material known to those skilled in the art. By maintaining a predetermined cool temperature range within the cavity 26, one can be assured that the ice 16 will remain solid for a desired period of time.

Method of Serving a Drink to a Person

Figure 15:
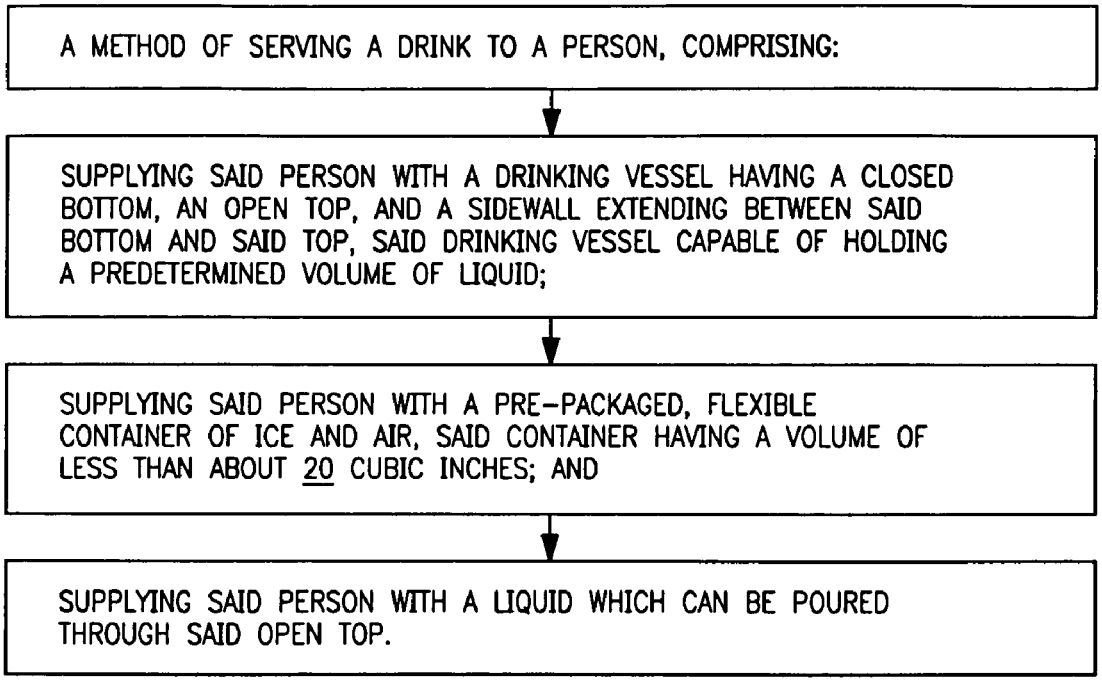
FIG. 15 is a flow diagram of a method of serving a drink to a person.
Figure 18:
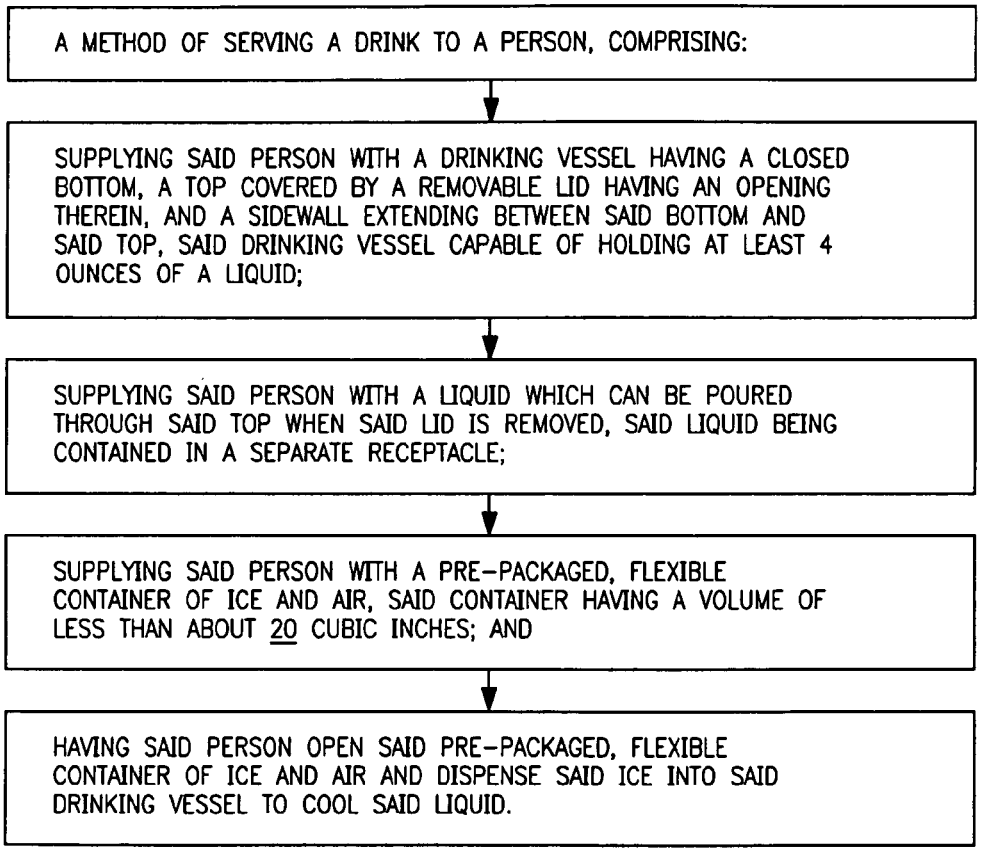
FIG. 18 is a flow diagram of an alternative method of serving a drink to a person.
Figure 19:
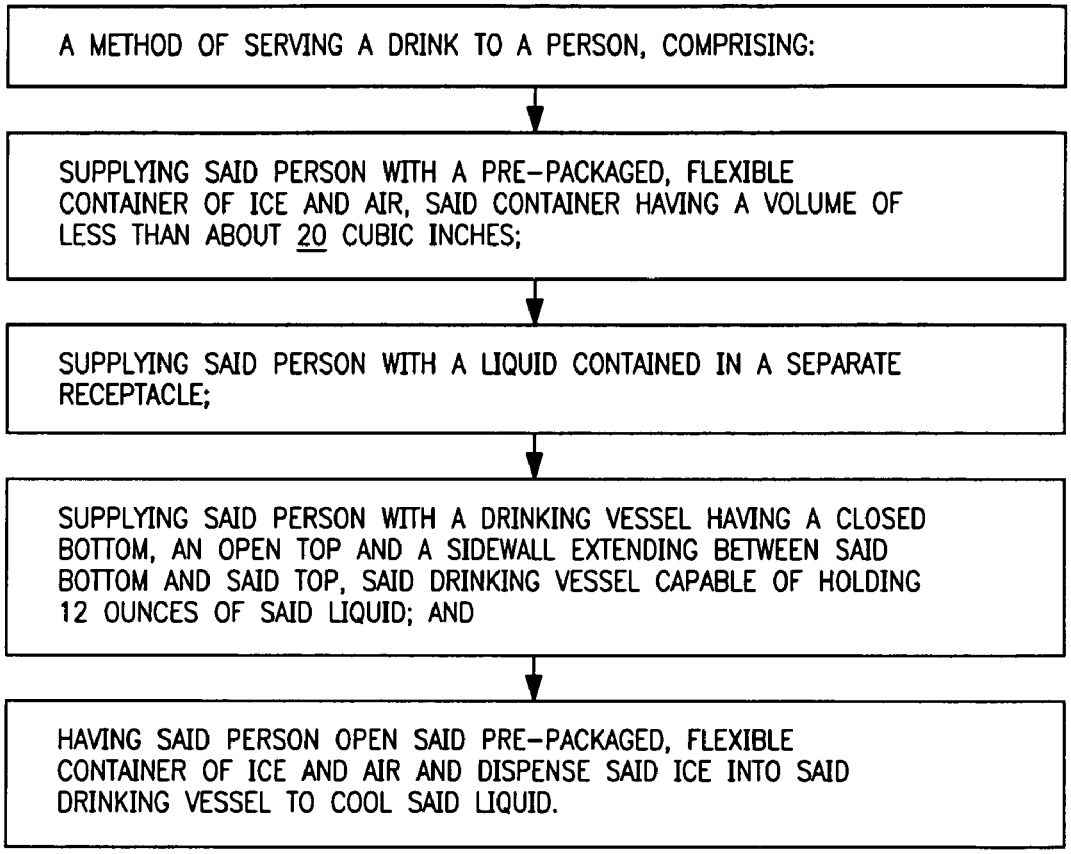
FIG. 19 is a flow diagram of still another method of serving a drink to a person.

Referring to FIGS. 15, 18 and 19, three different flow diagrams are shown depicting the various steps involved in a method of serving a drink to a person. Again, for discussion purposes only, the method will be described referring to the flexible container 14. However, it should be understood that the method could be used with the flexible container 14', 14" or 72.

Figure 16:
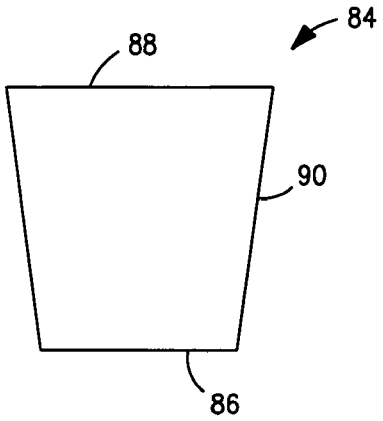
FIG. 16 is a side view of a drinking vessel.

Referring to FIG. 16, the method includes supplying or providing a person with a drinking vessel 84. The drinking vessel 84 has a closed bottom 86, an open top 88, and a sidewall 90 extending between the bottom 86 and the top 88. The drinking vessel 84 is depicted as a glass or cup which is capable of holding a predetermined volume of liquid. For example, the drinking vessel 84 can be designed to hold anywhere from about 1 ounce to about 24 ounces. A shot glass would hold about 1 ounce while a large beverage cup from a fast food restaurant can hold up to 24 ounces. The drinking vessel 84 will typically have a capacity for holding an even number of ounces of a fluid or a liquid. For example, the drinking vessel 84 can be designed to hold 4, 6, 8, 10, 12, 16, 20 or 24 ounces of a liquid or a fluid. If desired, the drinking vessel 84 can be designed to hold an odd number of ounces of a fluid or a liquid. For example, the drinking vessel 84 could be designed and constructed to hold 1, 3, 5, 7, 9, etc. ounces of a fluid or a liquid.

The drinking vessel 84 can be formed in various sizes and can have an infinite variety of shapes and configurations. For example, the drinking vessel 84 could include a stem, such as is common with a wine glass, it could include a handle, such as is common with a beer mug, or it could include a permanent cover that is movable, such as by a hinge, relative to a sidewall, such as is common with some old fashion beer steins. The drinking vessel 84 can have a flat bottom 86, a concave bottom, an arcuate bottom, etc. The drinking vessel 84 can have one or more straight, curved or arcuately shaped sidewalls 90. The sidewalls 90 can be tapered or aligned parallel to one another. The sidewalls 90 can also be arcuate in profile, if desired. The drinking vessel 84 can be formed from a variety of materials, including but not limited to: glass, crystal, plastic, clear plastic, thermoplastic, a composite having one or more layers, paper, wax paper, treated or coated paper, foam, Styrofoam, etc. A combination of two or more different materials can also be used to construct the drinking vessel 84. Furthermore, an insulating material can be incorporated into the design of the drinking vessel 84 to assist in keeping the fluid or liquid at a desired temperature for a certain period of time. Desirably, the drinking vessel 84 is made of plastic or glass. By "glass" it is meant any of a large class of materials that are typically made by silicates fusing with boric oxide, aluminum oxide, or phosphorous pentoxide, are generally hard, brittle, and transparent or translucent, and are considered to be supercooled liquids that form non-crystalline solids.

Figure 17:
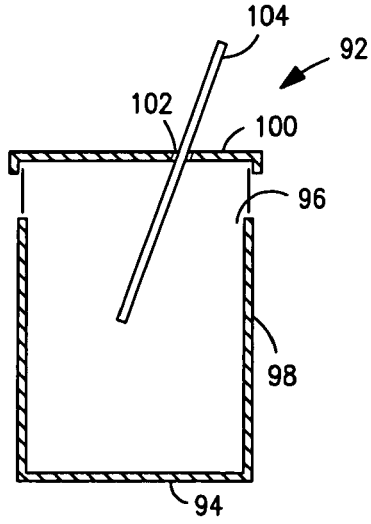
FIG. 17 is an exploded, cross-sectional view of another embodiment of a drinking vessel having a removable lid and a straw which is inserted through an opening formed in the lid.

Referring to FIG. 17, an exploded cross-sectional view of another embodiment of a drinking vessel 92 is shown. The drinking vessel 92 has a closed bottom 94, an open top 96 and a sidewall 98 extending between the bottom 94 and the top 96. The top 96 of the drinking vessel 92 is designed to be covered by a removable lid 100 having an opening 102 formed therethrough. For example, the opening 102 can be sized and configured to receive a straw 104. The removable lid 100 can be friction fitted over the top 96 of the drinking vessel 92. Likewise, other known means of securing the removable lid 100 to the drinking vessel 92 can be utilized.

Referring again to FIG. 15, the method also includes supplying the person with a pre-packaged, flexible container 14 of ice 16 and air 18. The flexible container 14 has a volume of less than about 20 cubic inches or less. Desirably, the flexible container 14 has a volume of less than about 19 cubic inches. More desirably, the flexible container 14 has a volume of less than about 18 cubic inches. Even more desirably, the flexible container 14 has a volume of from between about 10 cubic inches to about 20 cubic inches.

The flexible container 14 is designed to hold one or more pieces of the ice 16. Desirably, multiple pieces of ice are present in the flexible container 14. The amount of the ice 16 present should be sufficient to cool the liquid or fluid poured into the drinking vessel 84 or 92. The ice 16 can be in various shapes and sizes as explained above. Desirably, the ice 16 is in the form of individual ice cubes each having a temperature of about 32° F. Desirably, the ice 16 is at a temperature of less than about 32° F. More desirably, the ice 16 is at a temperature below 32° F. when it is inserted into the flexible container 14. Once the flexible container 14 is moved to an area maintained at room temperature, the ice 16 will slowly start to melt. Hopefully, the ice 16 stored within the flexible container 14 will be used before it melts into water.

When multiple pieces of the ice 16 are inserted and stored in the flexible container 14, the ice 16 should have a total weight of less than about 5 ounces. Desirably, the ice 16 stored in the flexible container 14 will have a total weight of less than about 4 ounces. More desirably, the ice 16 stored in the flexible container 14 will have a total weight of less than about 3 ounces.

The amount of air 18 present in the volume of the flexible container 14 should be at least about 50%. Desirably, the amount of air 18 present in the volume of the flexible container 14 should range from between about 55% to about 75%. More desirably, the amount of air 18 present in the volume of the flexible container 14 should range from between about 55% to about 65%. Even more desirably, the amount of air 18 present in the volume of the flexible container 14 should range from between about 55% to about 60%. The temperature of the air 18 within the flexible container 14 can range from between about 10° F. to about room temperature. Desirably, the temperature of the air 18 within the flexible container 14 will range from between about 10° F. to about 35° F. More desirably, the temperature of the air 18 within the flexible container 14 will be about 32° F. Even more desirably, the temperature of the air 18 within the flexible container 14 will be less than or below about 32° F.

As mentioned above with reference to FIG. 5, the flexible container 14 can include a tear strip 30 to facilitate opening the flexible container 14. Optionally, a resealable opening can be substituted in place of the tear strip 30. Resealable devices for resealing or closing an opening in a flexible container 14, that has been opened at least once, are well known to those skilled in the packaging art. For example, the resealable device can consist of an elongated strip of material that can be inserted between an elongated U-shaped member to form a secure, air tight attachment.

Referring now to FIG. 18 another embodiment of a method of serving a drink to a person is depicted. This method includes the steps of supplying a person with a drinking vessel 92 having a closed bottom 94, a top 96 and a sidewall 98 extending between the bottom 94 and the top 96. The drinking vessel 92, see FIG. 17, also has a removable lid 100 with an opening 102 formed therein. The lid 100 is sized and constructed to fit over the top 96 and provide a secure cover for the opening in the drinking vessel 92. Desirably, the removable lid 100 is friction fitted over the top 96 of the drinking vessel 92. The drinking vessel 92 is designed to hold a predetermined amount of liquid or fluid. The exact amount of liquid or fluid can vary. For example, the drinking vessel 92 can be constructed to hold from between about 1 to 24 ounces of a liquid or fluid. Desirably, the drinking vessel 92 is constructed to hold from about 4 to about 16 ounces of a liquid or fluid. More desirably, the drinking vessel 92 is constructed to hold from about 4 to about 12 ounces of a liquid or fluid.

The method also includes supplying the person with a liquid or fluid which can be poured through the top 96 when the lid 100 is removed. The liquid or fluid can be stored in an individual, separate receptacle, such as in an aluminum can, or in a plastic or glass bottle. The method further includes supplying the person with a pre-packaged, flexible container 14 of ice 16 and air 18. The flexible container 14 has a volume of less than about 20 cubic inches. Desirably, the flexible container 14 has a volume of less than about 19 cubic inches. More desirably, the flexible container 14 has a volume of less than about 18 cubic inches. The person then opens the pre-packaged, flexible container 14 of the ice 16 and the air 18 and dispenses the ice 16 into the drinking vessel 92 to cool the liquid or fluid.

Lastly, referring to FIG. 19, still another embodiment of a method of serving a drink to a person is depicted. This method includes the steps of supplying a person with a pre-packaged, flexible container 14 of ice 16 and air 18. The flexible container 14 has a volume of less than about 20 cubic inches. Desirably, the flexible container 14 has a volume of less than about 19 cubic inches. More desirably, the flexible container 14 has a volume of less than about 18 cubic inches.

The method also includes supplying the person with a liquid or fluid contained in a separate receptacle. The separate receptacle can be an aluminum can, a plastic bottle, a glass bottle, etc. having a volume of about 12 ounces. Optionally, the aluminum can, plastic bottle or glass bottle can have a fluid capacity of from between about 6 to about 16 ounces. Alternatively, the separate receptacle can be an insulated cup formed from Styrofoam having a fluid capacity of less than about 12 ounces.

The method further includes supplying the person with a drinking vessel 84, see FIG. 16, having a closed bottom 86, an open top 88 and a sidewall 90 extending between the bottom 86 and the top 90. The drinking vessel 84 should be capable of holding about 12 ounces of a liquid or fluid. The person then opens the pre-packaged, flexible container 14 of the ice 16 and the air 18 and dispenses the ice 16 into the drinking vessel 84 to cool the liquid or fluid.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. An individualized, pre-packaged, flexible container of ice and air, comprising:

a) a container which is designed to be opened such that said ice that is stored therein can be dispensed into a drinking vessel, said container including a first liquid-impermeable, transparent member and a second liquid-impermeable, transparent member aligned with one another to form a coterminuous outer periphery with a cavity formed therein, said cavity having a volume of less than about 20 cubic inches;

b) a seal formed about said outer periphery which bonds said first member to said second member and completely encloses said cavity, said seal being formed inside of and being spaced apart from said outer periphery; and c) ice and air contained within said cavity, said ice including an individual piece and said air occupying at least about 50% of said volume of said cavity, said air having a pressure of at least $1.01325\times10^5$ Pascal's and being at a temperature of less than about 32° Fahrenheit, and said container, ice and air having a combined weight of less than about 5 ounces.

2. The pre-packaged, flexible container of claim 1 wherein each of said first and second members are formed from a plastic material having a thickness of less than about 5 millimeters, and said air being at a pressure above atmospheric pressure.

3. The pre-packaged, flexible container of claim 2 wherein said plastic material is polypropylene.

4. The pre-packaged, flexible container of claim 3 wherein said first member includes a tear strip to facilitate opening said container such that said ice can be dispensed into a drinking vessel for the purpose of cooling a liquid retained in said drinking vessel.

5. The pre-packaged, flexible container of claim 1 wherein said ice includes multiple individual ice cubes having a total weight of less than about 3 ounces, each ice cube being about 1 inch by about 1 inch by about 1.25 inches in dimension, said container, ice and air having a combined weight of less than about 4 ounces, and said seal is a hermetical seal formed by ultrasonic energy.

6. The pre-packaged, flexible container of claim 1 wherein said cavity has a volume of from between about 5 cubic inches to about 20 cubic inches, and said seal is formed by heat and pressure.

7. The pre-packaged, flexible container of claim 6 wherein said air occupies from between about 55% to about 75% of said volume of said cavity, said air is at a temperature ranging from between about 10° F. to about 32° F., and said air being at a pressure above atmospheric pressure.

8. The pre-packaged, flexible container of claim 7 wherein said air occupies from between about 55% to about 65% of said volume of said cavity, and said container has a square configuration with four equal sides, and each of said sides has a dimension of less than about 4 inches.

9. The pre-packaged, flexible container of claim 7 wherein said air occupies from between about 55% to about 60% of said volume of said cavity, said container has a rectangular configuration with two oppositely aligned ends and two oppositely aligned sides, and each of said ends has a dimension of less than about 3 inches and each of said sides has a dimension of less than about 4 inches.

10. An individualized, pre-packaged, flexible container of ice and air, comprising:

a) a container which is designed to be opened such that said ice that is stored therein can be dispensed into a drinking vessel, said container including a first liquid-impermeable, transparent member folded upon itself and having a first folded end, a pair of second ends, a pair of sides, and an outer periphery;

b) a seal formed about at least a portion of said outer periphery which cooperates with said first folded end to completely enclose a cavity therein, said cavity having a volume of less than about 20 cubic inches, said seal being formed inside of and being spaced apart from said outer periphery; and c) ice and air contained within said cavity, said ice including multiple individual pieces and said air occupying more than 50% of said volume of said cavity, said air being at a pressure above atmospheric pressure, said ice and air being at a temperature of less than 32° Fahrenheit, and said container, ice and air having a combined weight of from between about 2 ounces to about 5 ounces.

11. The pre-packaged, flexible container of claim 10 wherein said air occupies from between about 55% to about 75% of said volume of said cavity, said air is at a temperature ranging from between about 10° F. to about 32° F., and a V-shaped notch is formed partially through said seal at one of said pair of sides to facilitate opening said container.

12. The pre-packaged, flexible container of claim 10 wherein said multiple individual pieces of ice have a total weight of less than about 3 ounces.

13. The pre-packaged, flexible container of claim 10 wherein said first member is a thermoplastic having a thickness of less than about 3 millimeters.

14. The pre-packaged, flexible container of claim 13 wherein said thermoplastic is polyethylene.

15. The pre-packaged, flexible container of claim 14 wherein said first member includes a tear strip to facilitate opening said container, and said tear strip extends from one of said sides to said opposite side.

16. An individualized, pre-packaged, flexible container of ice and air, comprising:

a) a container which is designed to be opened such that said ice that is stored therein can be dispensed into a drinking vessel, said container including a first liquid-impermeable, transparent plastic member and a second liquid-impermeable, transparent plastic member aligned with one another to have a coterminuous outer periphery with a cavity formed therein, said first and second member being constructed of the same plastic material, and said cavity having a volume of less than about 20 cubic inches;

b) a seal formed about said outer periphery which bonds said first member to said second member and completely encloses said cavity, said seal being formed inside of and being spaced apart from said outer periphery; and c) ice and air contained within said volume of said cavity, said ice including multiple individual pieces having a total weight of less than about 3 ounces, said air occupying more than about 50% of said volume of said cavity, said air having a pressure of at least $1.01325\times10^5$ Pascal's, said ice and air being at a temperature of less than about 32° Fahrenheit, and said container, ice and air having a combined weight of less than about 4 ounces.

17. The pre-packaged, flexible container of claim 16 wherein said multiple individual pieces of ice are each in the form of a cube having dimensions of about 1 inch by 1 inch by 1.25 inches.

18. The pre-packaged, flexible container of claim 16 wherein said air occupies from between about 55% to about 75% of said volume of said cavity, said air is at a temperature ranging from between about 10° F. to about 32° F., and said multiple individual pieces of ice have a total weight of less than about 2.9 ounces.

19. The pre-packaged, flexible container of claim 16 wherein said container has a geometrical configuration with at least three sides, and none of said sides has a dimension greater than about 4 inches.

20. The pre-packaged, flexible container of claim 16 wherein said first member is formed from polyethylene, said first member includes a tear strip and said tear strip extends from a first side of said container to a second side of said container, and a finger tab integrally formed with said tear strip and extending outward beyond said second side, said finger tab permitting a person to grasp it between a thumb and a forefinger and pull said tear strip back and away from said second side to open said container.

* * * * *

UNITED STATES PATENT AND TRADEMARK OFFICE

CERTIFICATE OF CORRECTION

PATENT NO. : 7,900,471 B2
APPLICATION NO. : 12/154709
DATED : March 8, 2011
INVENTOR(S) : Thomas R. Leske It is certified that error appears in the above-identified patent and that said Letters Patent is hereby corrected as shown below:

In column 4, line 7 of the patent as granted, "320" should be replaced with "32°".

Signed and Sealed this
Fifth Day of July, 2011

David J. Kappos

David J. Kappos
*Director of the United States Patent and Trademark Office*